United States Patent [19]

Goodrich

[11] 4,054,026

[45] Oct. 18, 1977

[54] BOTTLE-TIMER ASSEMBLY

[76] Inventor: Robert S. Goodrich, 27901 S. Golden Meadow Drive, Rancho Palos Verdes, Calif. 90274

[21] Appl. No.: 710,276

[22] Filed: July 30, 1976

[51] Int. Cl.[2] ..... G04F 7/08; G04B 37/02; G04B 37/12

[52] U.S. Cl. ..... 58/1 R; 58/53; 58/144; 58/152 R

[58] Field of Search ..... 58/1, 53, 56, 88 R, 58/144, 152 R

[56] References Cited

U.S. PATENT DOCUMENTS

| | | | |
|---|---|---|---|
| 1,641,343 | 9/1927 | Maynard | 58/144 |
| 2,684,152 | 7/1954 | Schweiger | 58/144 |
| 3,120,735 | 2/1964 | McMeans | 58/144 |
| 3,240,007 | 3/1966 | Dock et al. | 58/144 |

*Primary Examiner*—E. S. Jackmon
*Attorney, Agent, or Firm*—Edward A. Sokolski

[57] ABSTRACT

A bottle which may be used to contain a liquid has a timer mounted therein to provide an indication of elapsed time. This timer is formed from a transparent tube sealed at the opposite ends thereof and having an object which is free to move in the liquid and which has a specific gravity different from that of such fluid. The tube has a member at one end therof which functions to retain the tube in the bottle and to provide a spout for pouring the fluid from the bottle. In the preferred embodiment, timing is provided as a function of the speed of movement of the object through the fluid when the tube and bottle are placed in a generally vertical orientation.

12 Claims, 8 Drawing Figures

BOTTLE-TIMER ASSEMBLY

This invention relates to timing devices and more particularly to such a device assembled in a bottle and providing timing as a function of the movement of an object through a fluid.

In a situation such as sunbathing, it is highly desirable to have an indication of how much time has elapsed since initial exposure to the sun to avoid over-exposure. It is inconvenient to carry a watch for this purpose in public places, as if one desires to go bathing there is usually no safe-keeping place to leave the watch during this time. It therefore would be highly convenient to have an inexpensive disposable timer for this purpose.

In U.S. Pat. Nos. 3,166,839 and 3,240,007, timer devices are described which utilize a ball or like object placed in a liquid which is contained within a tube, this ball having a different specific gravity than the liquid so that it drops (or rises) in the liquid when the tube is placed in an essentially vertical orientation. The time it takes for the ball to move a predetermined distance within the tube can be calibrated by adjusting the relationship between the specific gravity of the ball and the fluid. This type of timing device is simple, reliable and relatively accurate in operation, and very economical in construction.

The device of the present invention is an improvement on the timer device of the aforementioned patents and further incorporates this timer in a bottle assembly which can contain a fluid such as suntan oil or lotion which is generally used by bathers. The device of the present invention thus provides the dual function of containing and dispensing a liquid and providing a timing indication, this device being of highly economical, simple and durable construction.

It is therefore an object of this invention to provide a simple and economical timer device incorporated in a bottle assembly.

It is a further object of this invention to provide a bottle-timer assembly which can be used by a sunbather for both containing and dispensing suntan oil or lotion and timing sunbathing.

It is still another object of this invention to provide a novelty item having the dual functions of providing a timing indication and containing and dispensing a liquid.

Other objects of this invention will become apparent as the description proceeds in connection with the accompanying drawings of which:

Briefly described, my invention is as follows: A timer tube sealed at the opposite ends thereof has an object such as a ball and a liquid contained therein, the object and liquid being of different specific gravities. The tube has a member attached to one end thereof which seals this one end and which duly functions to fixedly retain the tube within a bottle and to provide a spigot for liquid contained within the bottle. A timing indication is provided with the tube and bottle oriented in a generally vertical position, this timing indication being provided as a function of the speed of motion of the object within the tube. Various versions of sealing device are provided for one end of the tube to compensate for contraction (and expansion) of the liquid so as to avoid the formation of an air bubble in the liquid which could adversely affect the accuracy of the timing. In a second embodiment suitable for use with opaque bottles or with non-transparent liquids contained within the bottle, the timing tube is mounted along the exterior wall of the bottle.

Figure 2:
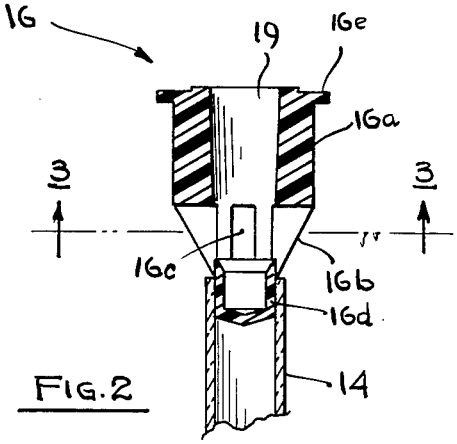
FIG. 2 is a cross-sectional view illustrating the spigot and retainer unit attached to one end of the timer tube of the preferred embodiment.
Figure 1:
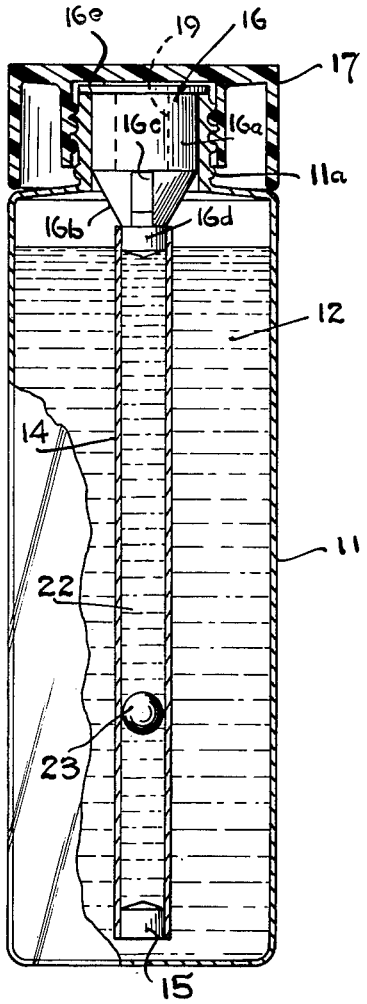
FIG. 1 is an elevational view of a preferred embodiment of the invention.
Figure 3:
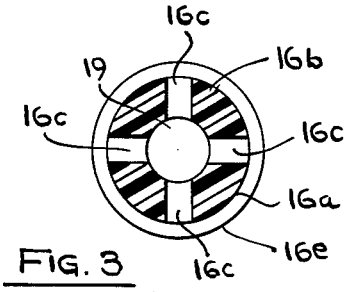
FIG. 3 is a cross-sectional view taken along the plane indicated by 3-3 in FIG. 2.

Referring to FIGS. 1-3, a first embodiment of the invention is illustrated. Bottle 11 is fabricated of a transparent material such as a suitable transparent plastic, and has a threaded neck portion 11*a.* Threadably attached to neck portion 11*a* is cap 17 which is used to seal the top of the bottle. Bottle 11 may have a clear liquid 12 contained therein, such as suntain oil or lotion. Timer tube 14 is fabricated of a transparent material such as suitable plastic and is contained within bottle 11. The bottom end of tube 14 is sealed by means of plug 15 which may be fabricated of an elastic material such as rubber or a suitable plastic which is fitted into the tube and which is capable of longitudinal movement therein in response to expansion and contraction of the liquid. Attached to the top end of tube 14, as for example by press fitting, and forming a seal therefor is member 16 which is used to suspend tube 14 from the neck 11*a* of the bottle, and which also serves as a spigot for the fluid 12 contained within the bottle. Member 16 has a first cylindrical portion 16*a,* a second cylindrical portion 16*d,* and a conical portion 16*b.* Conical portion 16*b* has a plurality of apertures 16*c* formed therein which provide fluid communication between the inside of bottle 11 and the cavity formed by the interior walls of cylindrical portion 16*a.* Cylindrical portion 16*d* of member 16 forms a plug for tube 14 and may be cemented thereto.

Contained within tube 14 are a liquid 22 and a ball 23 which have different specific gravities. Where ball 23 is made to have a greater specific gravity than the fluid, the ball will fall within the tube when the tube is oriented generally vertically. On the other hand, if ball 23 is made to have a lesser specific gravity than the fluid, the ball will rise in the tube under these conditions. Ball 23 is made to have a size such that there is viscous friction caused by the fluid between the walls of tube 14 and the diameter of the ball. This friction along with other factors such as the viscosity of the fluid and the relative specific gravities of the ball and the liquid determine the rate at which the ball moves within the tube. This is preferably made to be a relatively slow rate to provide reasonably long timing intervals for the travel of the ball between the opposite ends of the tube. The walls of tube 14 may be marked with indicia to indicate various timing intervals.

In the use of the device, bottle 11 is vertically oriented for a sufficient period of time to permit ball 23 to travel to one end of the tube. The bottle may then be inverted and the rate of travel of the ball through the tube used to provide a timing indication. The cylindrical portion 16*a* of member 16 is fixedly attached to the neck portion 11*a* of the bottle as, for example, by press fitting, with ledge portion 16*e* of this member resting against the top edge of the neck of the bottle. Fluid is poured from the bottle through apertures 16*c* and the cylindrical opening 19 formed in the central portion of member 16. Thus member 16 serves both to support tube 14 and to provide a spigot for the liquid.

It has been found that bubbles can form in liquid 22 with expansion and contraction thereof due to temperature changes, unless some means are provided to compensate for this expansion and contraction. Such bubbles can change the timing operation significantly. Such variations in the volume of the liquid can be compensated for in various manners, as now to be described in connection with FIGS. 4–6.

Figure 4:
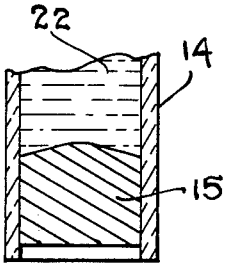
FIG. 4 is a cross-sectional view of a first version of a sealing device which may be used at one end of the timer tube of the preferred embodiment.

Referring to FIG. 4, plug member 15 is formed of an elastic material such as rubber or plastic, which is fitted into tube 11 and which is capable of longitudinal movement therein in response to expansion and contraction of the liquid in the tube.

Figure 5:
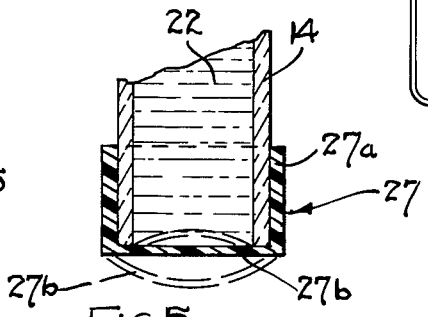
FIG. 5 is a cross-sectional view illustrating a second version of a sealing device which can be utilized in the timer tube of the preferred embodiment.

Referring now to FIG. 5, the bottom of tube 14 is sealed by means of a plastic cap 27 having a side wall portion 27*a* which is cemented to the wall of tube 14 and a flexible bottom portion 27*b* which forms a diaphragm and a bottom wall for the tube. Diaphragm 27A*b* moves outwardly and inwardly as indicated by the dotted lines, as the fluid within tube 14 expands and contracts.

Figure 6:
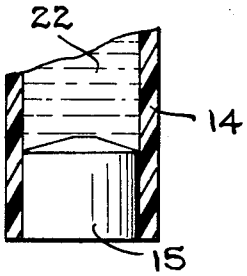
FIG. 6 is a cross-sectional view of an alternative type of timer tube that can be utilized in the preferred embodiment.

Referring now to FIG. 6, a further technique for avoiding the formation of bubbles is illustrated. In this last version, tube 14 is fabricated of a flexible plastic and a plug member 15 is cemented to the inner walls of the tube. Flexible tube 14 expands and contracts with expansion and contraction of the liquid, thus preventing the formation of bubbles therein. Tube 14 may be fabricated of a flexible clear plastic.

Figure 8:
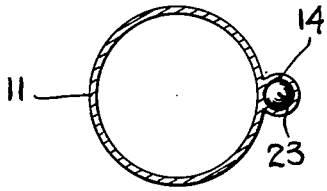
FIG. 8 is a cross-sectional view taken along the plane indicated by 8—8 in FIG. 7.
Figure 7:
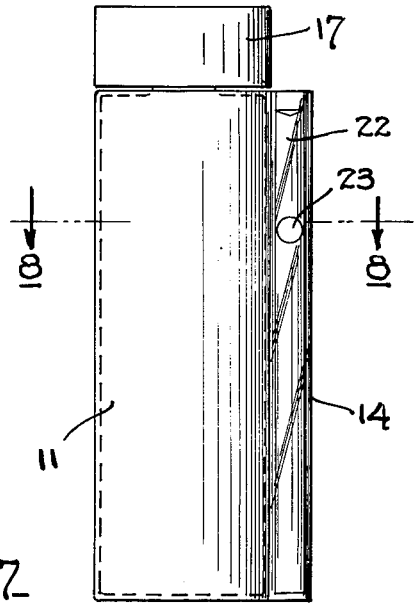
FIG. 7 is an elevational view of a second embodiment of the invention.

Referring now to FIGS. 7 and 8 a second embodiment of the invention is illustrated. This embodiment is suitable for use where the walls of bottle 11 are opaque or the liquid contained within bottle 11 is non-transparent. In this embodiment, tube 14 which is of a transparent material and has liquid 22 and a ball 23 contained therein, made in any one of the configurations described for the first embodiment, is attached to the other wall of bottle 11, as for example by cementing. Tube 14 may also be integrally formed with bottle 11. In this embodiment, of course, member 16 is eliminated and the spigot of bottle 11 may be of conventional design.

The device of this invention thus provides a simple and economical bottle-timer assembly which is particularly suitable for use in containing suntan oil and lotion and for providing a timing indication to bathers. The device of the invention could also be used in other applications, such as in the use of medical, photographic, cooking materials, etc.

While the invention has been described and illustrated in detail, it is to be clearly understood that this is intended by way of illustration and example only and is not to be taken by way of limitation, the spirit and scope of this invention being limited only by the terms of the following claims.

I claim:

1. A bottle-timer assembly comprising:

a transparent bottle, a transparent tube having a substantially smaller outside diameter than said bottle, means for sealing the opposite ends of said tube, the means for sealing one of the ends of said tube comprising a member having smaller and larger diameter cylindrical portions interconnected by a conical portion, the smaller diameter cylindrical portion forming a plug which is fitted within and attached to said one tube end, said member being attached to said bottle and thereby supporting said tube within said bottle, a fluid contained in said tube, and an object contained in said tube having a diameter less than the inside diameter of said tube, the specific gravities of said fluid and said object being different whereby said object moves along said tube at a predetermined rate when the tube is placed in a generally vertical orientation, to provide a timing indication.

2. The device of claim 1 wherein said object is a ball.

3. The device of claim 1 wherein said object has a greater specific gravity than the fluid.

4. The device of claim 1 wherein said fluid has a greater specific gravity than said objects.

5. The device of claim 1 wherein said bottle has a neck portion, the larger diameter cylindrical portion of said member being fitted in and attached to said neck portion, said larger diameter cylindrical portion and said conical portion having a cavity formed therein, said conical portion having aperture means formed therein providing fluid communication between the interior of said bottle and said cavity whereby said member serves as a spigot for the bottle and provides a support for suspending said tube in said bottle.

6. The device of claim 5 wherein said aperture means comprises a plurality of longitudinal apertures arranged around the circumference of said conical portion.

7. A bottle-timer assembly comprising:

a transparent bottle having an open cylindrical neck, a transparent tube having a substantially smaller diameter than said bottle, means for sealing one of the ends of said tube, a member attached to the other end of said tube having smaller and larger diameter cylindrical portions interconnected by a conical portion, said smaller diameter cylindrical portion forming a plug which is fitted within said tube to form a seal for the other end thereof, said larger diameter cylindrical portion being fitted within and attached to the neck of said bottle, said larger diameter cylindrical portion and said conical portion having a cavity formed therein, said conical portion having aperture means formed therein providing fluid communication between the interior of the bottle and said cavity, said member serving as a spigot for the bottle and providing a support for suspending the tube in the bottle, a liquid contained in said tube, and an object contained in the tube having a diameter less than the inside diameter of the tube, the specific gravities of said liquid and said object being different whereby said object moves along said tube at a predetermined rate when the tube is placed in a generally vertical orientation to provide a timing indicator.

8. The assembly of claim 7 wherein said aperture means comprises a plurality of elongated apertures symmetrically arranged around the circumference of said conical portion.

9. The assembly of claim 7 wherein said object has a greater specific gravity than the liquid.

10. The assembly of claim 7 wherein the liquid has a greater specific gravity than the object.

11. The assembly of claim 7 wherein said means for sealing one of the ends of the tube comprises a plug of elastic material fitted into said tube and capable of longitudinal movement therein in response to expansion and contraction of the liquid.

12. The assembly of claim 7 wherein said means for sealing said one of the ends of the tube comprises a cap attached to said tube at said one of the ends thereof having a flexible diaphragm covering said one end which moves outwardly and inwardly with expansion and contraction of the liquid.

* * * * *